US010117032B2

(12) United States Patent
Gordon et al.

(10) Patent No.: US 10,117,032 B2
(45) Date of Patent: Oct. 30, 2018

(54) HEARING AID SYSTEM, METHOD, AND RECORDING MEDIUM

(71) Applicant: International Business Machines Corporation, Armonk, NY (US)

(72) Inventors: Michael S. Gordon, Yorktown Heights, NY (US); James R. Kozloski, New Fairfield, CT (US); Ashish Kundu, Elmsford, NY (US); Peter K. Malkin, Yorktown Heights, NY (US); Clifford A. Pickover, Yorktown Heights, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 14 days.

(21) Appl. No.: 15/076,784

(22) Filed: Mar. 22, 2016

(65) Prior Publication Data

US 2017/0280257 A1 Sep. 28, 2017

(51) Int. Cl.
*H04R 25/00* (2006.01)

(52) U.S. Cl.
CPC ..... *H04R 25/558* (2013.01); *H04R 25/50* (2013.01)

(58) Field of Classification Search
CPC ..... H04R 25/00; H04R 25/55; H04R 25/65; H04R 25/558
USPC ..... 381/312–331
See application file for complete search history.

(56) References Cited

U.S. PATENT DOCUMENTS 5,636,285 A * 6/1997 Sauer ..... H04R 25/507 381/312
6,236,731 B1 * 5/2001 Brennan ..... H03H 17/0266 381/312
9,700,261 B2 * 7/2017 Lunner ..... A61B 5/6817
2005/0287501 A1 12/2005 Sweetow et al.
2006/0029912 A1 2/2006 Kearby et al.
2010/0196861 A1 * 8/2010 Lunner ..... H04R 25/505 434/112
2011/0249836 A1 * 10/2011 Solum ..... H04R 25/558 381/314
2014/0098981 A1 * 4/2014 Lunner ..... H04R 25/70 381/320
2014/0369536 A1 * 12/2014 Kirkwood ..... H04R 25/55 381/312
2014/0369537 A1 * 12/2014 Pontoppidan ..... H04R 25/00 381/314

(Continued)

OTHER PUBLICATIONS

Aldaz, G. et al.; "User Experience in Training a Personalized Hearing System"; User Experience Design for Everyday Life Applications & Services, 3rd International Conference, Held as Part of HCI International 2014, LNCS 8519, pp. 3-14. 2014.

(Continued)

*Primary Examiner* — Suhan Ni
(74) *Attorney, Agent, or Firm* — Rahan Uddin, Esq.; McGinn IP Law Group, PLLC

(57) ABSTRACT

A hearing aid method, system, and non-transitory computer readable medium, include a cognitive state analysis circuit configured to analyze a cognitive state of a user, a context analysis circuit configured to analyze a context of the user, and an audio characteristic controller configures to control an audio characteristic of a hearing aid based on a joint assessment of the cognitive state of the user and the context of the user.

19 Claims, 6 Drawing Sheets

(56) References Cited

U.S. PATENT DOCUMENTS

| | | | | |
|---|---|---|---|---|
| 2015/0023536 | A1* | 1/2015 | Scheller | H04R 25/30 381/315 |
| 2016/0021302 | A1* | 1/2016 | Cho | H04N 5/23219 348/349 |
| 2016/0057547 | A1* | 2/2016 | Burger | H04R 25/00 381/315 |

OTHER PUBLICATIONS

Anonymously; "A Method and System for Detecting Cognitive Change of an Individual by Monitoring Communication Patterns"; http://ip.com/IPCOM/000242934D; Sep. 1, 2015.
Siemens et al.; "Individual Classifier for Hearing Aids"; http://ip.com/IPCOM/000207931D; Jun. 16, 2011.

* cited by examiner

HEARING AID NETWORK 300

HEARING AID SYSTEM, METHOD, AND RECORDING MEDIUM

BACKGROUND

The present invention relates generally to a hearing aid system, and more particularly, but not by way of limitation, to a method and system involving a hearing aid (e.g. in the ear), the audio characteristics of the system and method being controlled by a module that performs a joint assessment of the real-time cognitive state of the user along with an assessment of the real-time context of the user.

A hearing aid is conventionally an electroacoustic device designed to amplify sound for the wearer, usually with the aim of making speech more intelligible, and to correct impaired hearing as measured by audiometry. It is noted that a hearing aid and a telephone are "compatible" when they can connect to each other in a way that produces clear, easily-understood sound. The term "compatibility" is applied to all three types of telephones (e.g., wired, cordless, and mobile). There are several ways telephones and hearing aids can connect with each other, including acoustically: the sound from the phone's speaker is picked up by the hearing aid's microphone; and electromagnetically: the signal inside the phone's speaker is picked up by the hearing aid's "telecoil" or "T-coil", a special loop of wire inside the hearing aid. Many theatres and lecture halls are now equipped with assistive listening systems that transmit the sound directly from the stage. Many hearing aids now have both an omnidirectional and a directional microphone. Adaptive directional microphones vary the direction of maximum amplification.

In a conventional technique, in order to make the operation, control and/or program selection of a hearing aid easier and in order to make manual operations and actuation means superfluous, the operation (e.g., switching on/off, setting softer/louder, selection of a program matched to an auditory/ambient situation, etc.) or the control of a part of the hearing aid that influences the transmission characteristic of the amplifier ensues in the hearing aid by conventionally recognizing and evaluating a code word spoken by the hearing aid user.

Other conventional techniques include a hearing aid having a memory configured to store current configuration data and an accelerometer to convert mechanical motion into a signal representing the mechanical motion. The hearing aid further includes a logic circuit coupled to the accelerometer to receive the signal and to selectively update the configuration data based on the signal. The accelerometer may be a tri-axial accelerometer.

However, none of the conventional techniques considers an assessment of the real-time cognitive state of the user along with an assessment of the real-time context of the user to control audio characteristics.

SUMMARY

In one aspect of the invention and in view of the above drawbacks of the conventional systems, the inventors have considered a technical solution to the technical problem in conventional techniques by controlling audio characteristics of a hearing aid by a joint assessment including an assessment of the real-time cognitive state of the user along with an assessment of the real-time context of the user.

In an exemplary embodiment, the present invention can provide a hearing aid system, including a cognitive state analysis circuit configured to analyze a cognitive state of a user, a context analysis circuit configured to analyze a context of the user, and an audio characteristic controller configured to control an audio characteristic of a hearing aid based on a joint assessment of the cognitive state of the user and the context of the user.

Further, in another exemplary embodiment, the present invention can provide a hearing aid method, including analyzing a cognitive state of a user, analyzing a context of the user, and controlling an audio characteristic of a hearing aid based on a joint assessment of the cognitive state of the user and the context of the user.

Even further, in another exemplary embodiment, the present invention can provide a non-transitory computer-readable recording medium recording a hearing aid program, the program causing a computer to perform: analyzing a cognitive state of a user, analyzing a context of the user, and controlling an audio characteristic of a hearing aid based on a joint assessment of the cognitive state of the user and the context of the user.

There has thus been outlined, rather broadly, an embodiment of the invention in order that the detailed description thereof herein may be better understood, and in order that the present contribution to the art may be better appreciated. There are, of course, additional exemplary embodiments of the invention that will be described below and which will form the subject matter of the claims appended hereto.

It is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The exemplary aspects of the invention will be better understood from the following detailed description of the exemplary embodiments of the invention with reference to the drawings.

DETAILED DESCRIPTION OF THE EXEMPLARY EMBODIMENTS

Figure 1:
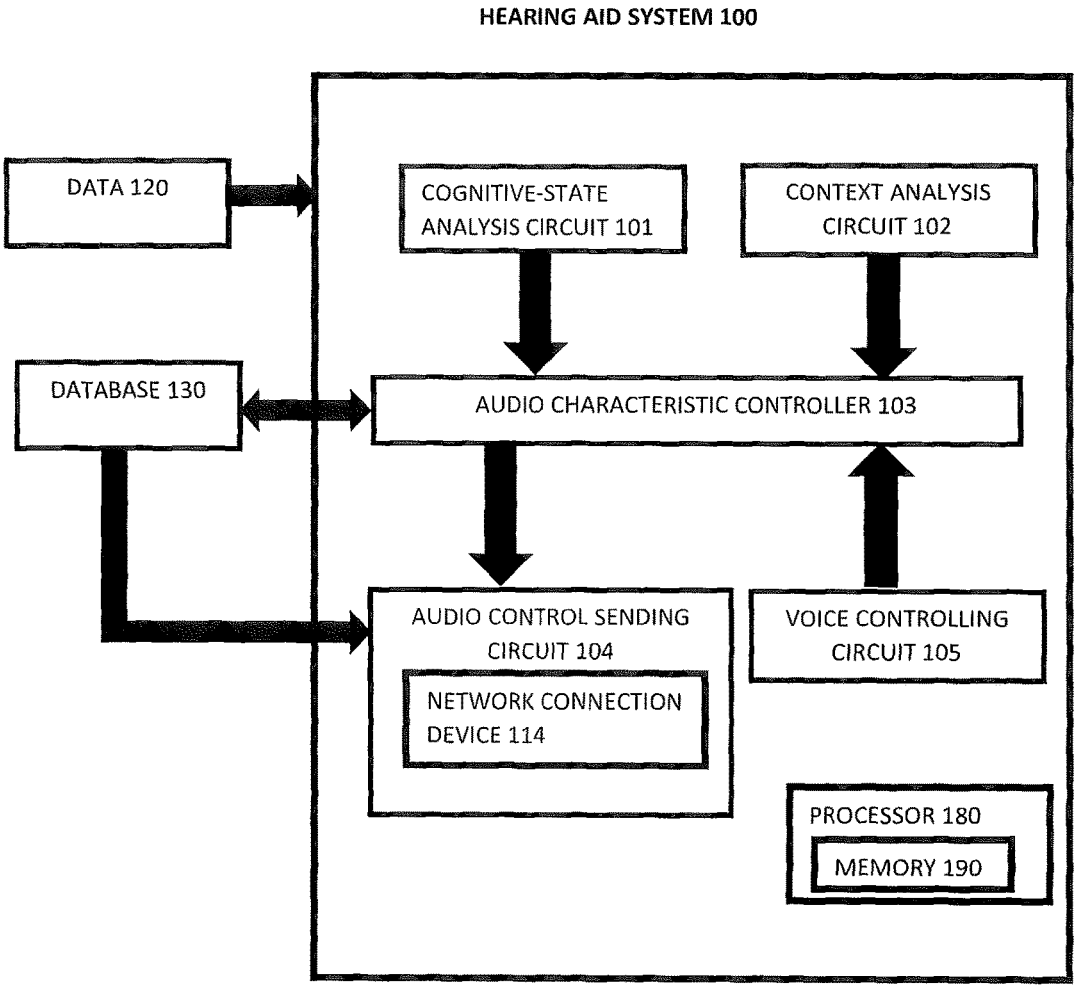
FIG. 1 exemplarily shows a block diagram illustrating a configuration of a hearing aid system 100.

The invention will now be described with reference to FIGS. 1-6, in which like reference numerals refer to like parts throughout. It is emphasized that, according to common practice, the various features of the drawing are not necessarily to scale. On the contrary, the dimensions of the various features can be arbitrarily expanded or reduced for clarity. Exemplary embodiments are provided below for illustration purposes and do not limit the claims.

With reference now to FIG. 1, the hearing aid system 100 includes a cognitive state analysis circuit 101, a contextual-state analysis circuit 102, an audio characteristic controller 103, an audio control sending circuit 104, and a voice controlling circuit 105. The hearing aid system 100 includes a processor 180 and a memory 190, with the memory 190 storing instructions to cause the processor 180 to execute each circuit of hearing aid system 100. The processor and memory may be physical hardware components, or a combination of hardware and software components.

Although the hearing aid system 100 includes various circuits, it should be noted that a hearing aid system can include modules in which the memory 190 stores instructions to cause the processor 180 to execute each module of hearing aid system 100.

Also, each circuit can be a stand-alone device, unit, module, etc. that can be interconnected to cooperatively produce a transformation to a result.

With the use of these various circuits, the hearing aid system 100 may act in a more sophisticated and useful fashion, and in a cognitive manner while giving the impression of mental abilities and processes related to knowledge, attention, memory, judgment and evaluation, reasoning, and advanced computation. That is, a system is said to be "cognitive" if it possesses macro-scale properties—perception, goal-oriented behavior, learning/memory and action—that characterize systems (i.e., humans) that all agree are cognitive.

Cognitive states are defined as functions of measures of a user's total behavior collected over some period of time from at least one personal information collector (including musculoskeletal gestures, speech gestures, eye movements, internal physiological changes, measured by imaging circuits, microphones, physiological and/or kinematic sensors in a high dimensional measurement space) within a lower dimensional feature space. In one exemplary embodiment, certain feature extraction techniques are used for identifying certain cognitive and emotional traits. Specifically, the reduction of a set of behavioral measures over some period of time to a set of feature nodes and vectors, corresponding to the behavioral measures' representations in the lower dimensional feature space, is used to identify the emergence of certain cognitive state(s) over that period of time. One or more exemplary embodiments use certain feature extraction techniques for identifying certain cognitive states. The relationship of one feature node to other similar nodes through edges in a graph corresponds to the temporal order of transitions from one set of measures and the feature nodes and vectors to another. Some connected subgraphs of the feature nodes are herein also defined as a cognitive state. The present application also describes the analysis, categorization, and identification of these cognitive states by means of further feature analysis of subgraphs, including dimensionality reduction of the subgraphs, for example by means of graphical analysis, which extracts topological features and categorizes the resultant subgraph and its associated feature nodes and edges within a subgraph feature space.

Figure 4:
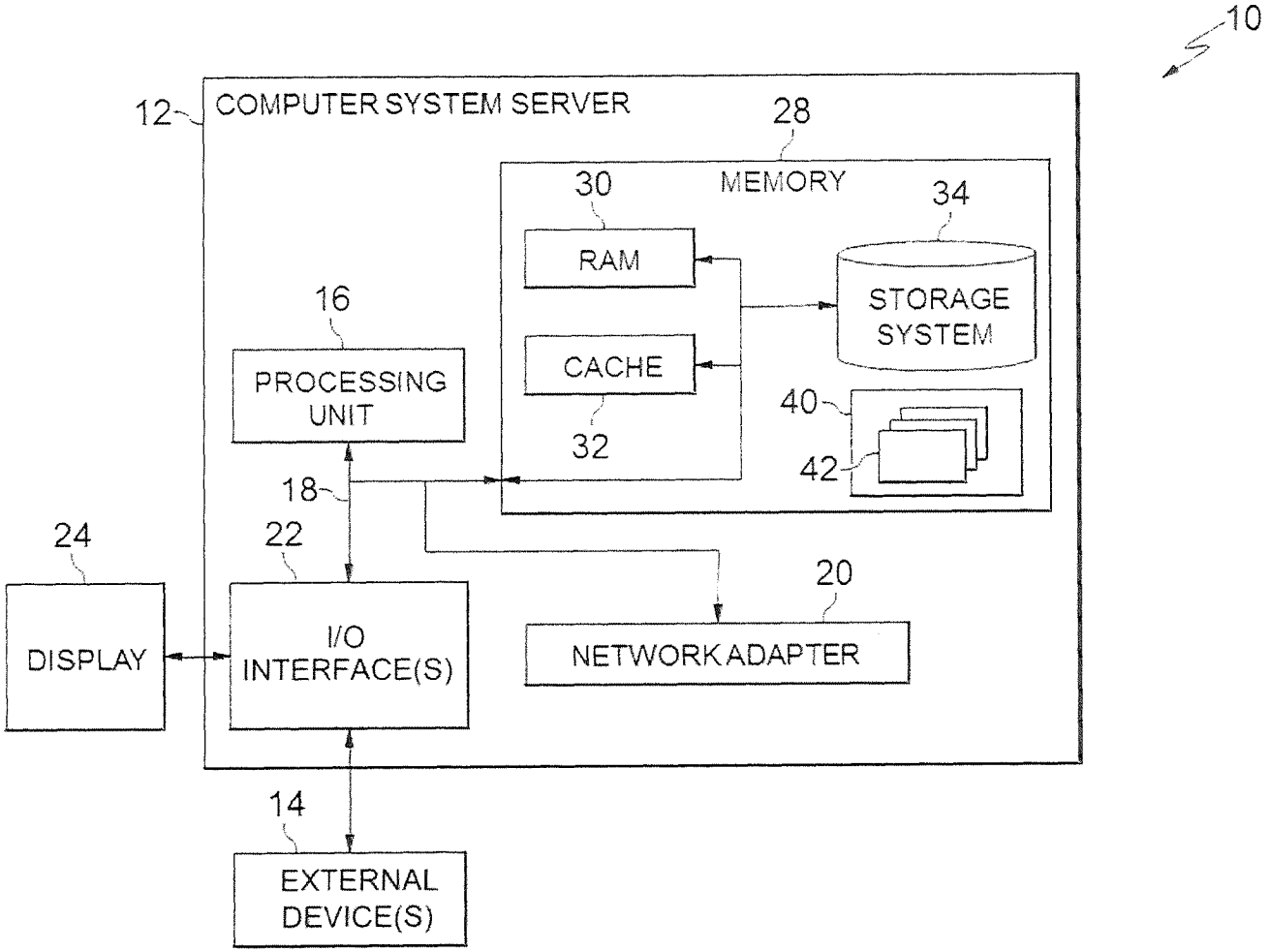
FIG. 4 depicts a cloud computing node 10 according to an embodiment of the present invention.
Figure 5:
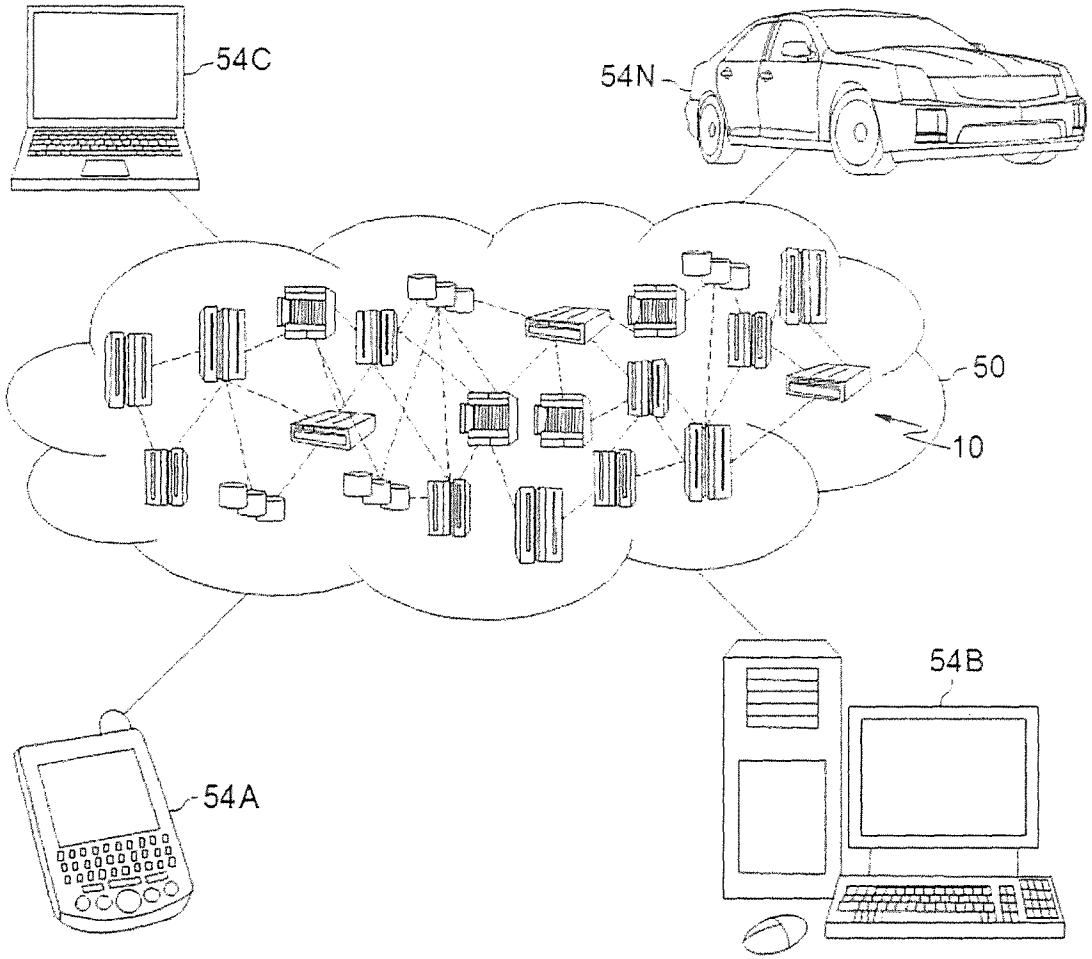
FIG. 5 depicts a cloud computing environment 50 according to another embodiment of the present invention.
Figure 6:
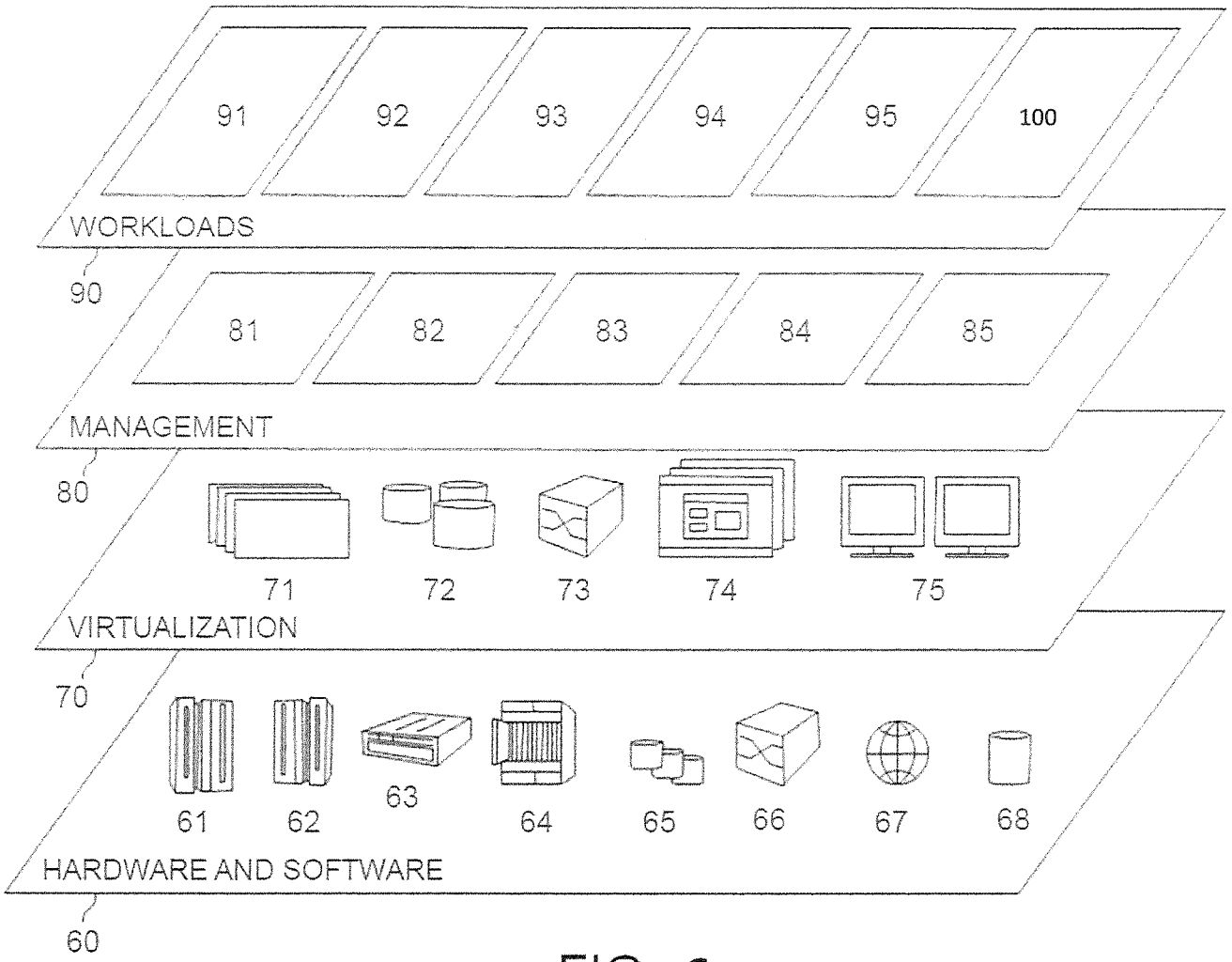
FIG. 6 depicts abstraction model layers according to an embodiment of the present invention.

Although as shown in FIGS. 4-6 and as described later, the computer system/server 12 is exemplarily shown in cloud computing node 10 as a general-purpose computing circuit which may execute in a layer the hearing aid system 100 (FIG. 6), it is noted that the present invention can be implemented outside of the cloud environment.

The hearing aid system 100 is installed in a hearing aid and the hearing aid system 100 receives data 120.

The data 120 includes information regarding a cognitive state of a user and context of the user and audio information.

The cognitive state can include, and not limited to, a cohort condition such as autism, attention-deficit disorder (ADD), attention-deficit hyperactivity disorder (ADHD), Asperger's syndrome, etc. and a cognitive level such as inebriation, fatigue, stress, distraction level, etc.

The context can include, but not limited to, a real-time assessment of another person speaking (e.g., based on facial recognition and/or voice recognition), an identity of the another person prior to the other person speaking (as will be discussed later), electronic calendar information (i.e., meeting topic, meeting attendees, roles and interrelationships between attendees, etc.), a real-time assessment of eye focus of user (i.e., looking at an eBook, looking at a person, looking at a teacher, looking at a text book as opposed to looking at a novel, looking out the window at a passing loud vehicle instead of a teacher, etc.), a teacher/student interaction, eye focus on a musical instrument (e.g. violin), etc.

The cognitive state analysis circuit 101 receives the data 120 and analyzes a cognitive state of the user, and provides a value representative of the cognitive state.

The context analysis circuit 102 receives the data 120 and analyzes a context of the user, and provides a value representing the context of the user.

The audio characteristic controller 103 controls audio characteristics by performing a joint assessment of the real-time cognitive state of the user along with an assessment of the real-time context of the user using the analysis (e.g., values) of the cognitive state analysis circuit 101 and the context analysis circuit 102.

The controlled audio characteristics include volume, frequency shaping, noise cancellation, playback, etc.

Based on the joint assessment, the audio characteristic controller 103 controls the audio characteristics.

For example, if it is determined that a first user is talking to a second user (e.g., based on a biometric analysis performed by the context analysis circuit 102 or even a secondary component such as a tiny video camera wireless adjunct), then the audio characteristic controller 103 may increase the volume and change the audio characteristics, because the second user has always had a difficult-to-understand or soft voice in the past when speaking to a first user. Sometimes, the audio characteristic controller 103 may block out extraneous sounds (e.g. by emitting a low level of white noise, pink noise, or brown noise) to help a user with ADD or ADHD focus their attention when the user's eyes are automatically determined to be currently looking at, for example, a history text book on the Kindle® as determined by the joint assessment using the cognitive state analysis circuit 101 and the context analysis circuit 102. In some cases, the user may be looking at a real person in the real world, but in related embodiments, the user may be looking at a character in a TV show, movie, virtual reality, or simply not paying attention to the speaker, etc.

The control function is then output to a database 130 to be stored.

Based on the stored audio characteristic controls in the database 130, particular audio characteristic control can be performed. For example, a user can be in the classroom for weeks, and each day, the user has been indicating on his smart watch a need for certain frequency spectral changes. The context analysis circuit 102 analyzes this input, stores an audio characteristic change based on this input, and then learns to perform future changes based on the stored change. Further, if the audio characteristic controller 103 changes a volume of the hearing aid based on a particular person's actions and/or being in proximity to the hearing aid user and stores the change in the database, the system 100 can learn to automatically change the audio characteristics when the person is present. In other words, the spoken volume of certain people can be "learned" and the listening preferences that the user has for these people is "learned" such that changes are automatically made when the person is speaking and the listener is a certain distance from the speaker.

The hearing aid system 100 can be used to support telephone calls and is not limited to "in the same room" audio. For example, the incoming conversant can be identified by their telephone number (provided by Caller-ID or the like) in the data 120. Thus, if the context analysis circuit 102 determines that a first user is calling, and it has been previously determined and stored in the database 120 that certain audio characteristics need to be changed when the first user is on the phone because the first user always speaks almost inaudibly low, and has a voice with certain features (e.g. spectral features), the audio characteristic controller 103 will automatically perform adequate amplification and frequency equalization based on speaker identification. In contrast, if the context analysis circuit 102 determines that a second user is calling (provided by Caller-ID or the like and it has been previously determined and stored in the database 120 that certain audio characteristics need to be changed when the first user is on the phone because the second user always speaks too loudly, then the audio characteristic controlling circuit 103 will automatically provide attenuation, partially muting, frequency/amplitude modulation, or the like of the broadcast audio as an audio characteristic change.

The audio characteristic controller 103 also may adjust the provided audio signal based on the role of the given conversant. For example, if the conversant is known to be a manager, a parent, a person in an authority position or the like, who are not likely to reduce their volume, then their signal(s) might be automatically attenuated or modulated. In contrast, if the conversant is a subordinate or a child, etc., then their audio signal(s) might be automatically amplified, especially in contexts where the primary user is patronizing or speaking condescendingly to the conversant.

Based on the joint assessment, the audio characteristic controller 103 can issue an alarm based on a range of high frequencies a given user can successfully hear according to their age.

The audio characteristic controller 103 uses the context and cognitive state to trigger "narrow directionality" which focuses more precisely on the speech source at the front of the hearing aid user/wearer by automatically narrowing the beam of the directional microphones. This helps wearers better recognize speech in demanding listening situations (e.g., crowded rooms, conferences, cocktail parties, etc.) while maintaining spatial awareness. Also, the audio characteristic controller 103 can trigger "spatial speech focus" which highlights dominant speech from any direction, while suppressing background noise. Such a feature may be automatically activated when the wearer is in a car; this feature does not affect spatial perception. The audio characteristic controller 103 can also trigger "eWindScreen binaural" in which when in a windy environment or location, the controller 103 strategically transmits audio signals from the instrument with better sound quality to the receiver, without compromising spatial perception or speech intelligibility.

Also, the hearing aid can include an accelerometer structure having a tri-axial accelerometer such that the cognitive state (e.g. inebriation, fatigue, anger, sickness/disease, etc.) can be estimated, with a certain degree of confidence, by many means including by using an accelerometer in the hearing aid.

Further, the hearing aid can include a Global Positional System (GPS). The GPS can allow the hearing aid can respond based on assessing that the wearer is walking, running, or riding a bike, based on background noise and his/her velocity.

The hearing aid system 100 further includes an audio control sending circuit 104 having a network connection device 114.

The audio control sending circuit 104 can be configured to send the audio characteristic control output from the audio characteristic controller 103 to other hearing aids that are connected to each other using the network connection device 114 or send prior audio characteristic control outputs stored in the database 130 to other hearing aids that are connected to each other using the network connection device 114.

Figure 3:
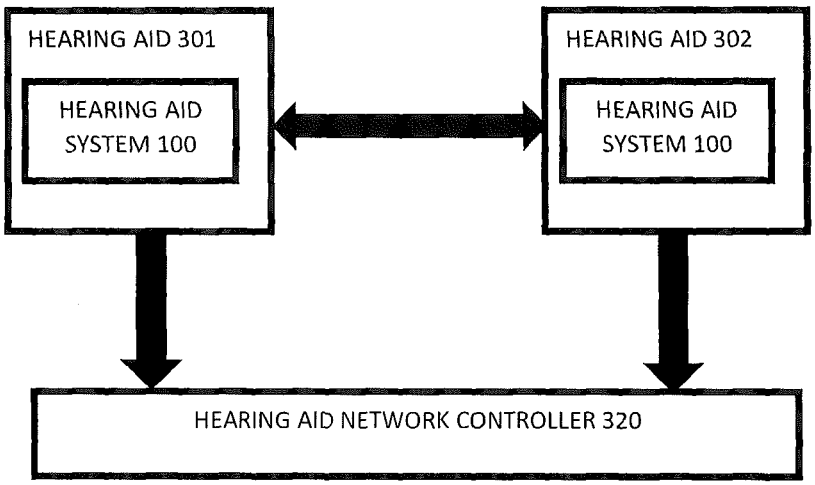
FIG. 3 exemplarily shows a block diagram illustration a configuration of a hearing aid network 300.

For example, as exemplarily shown in FIG. 3, the hearing aid system 100 can be installed in a first hearing aid 301 and a second hearing aid 302 to create a hearing aid network 300. The audio control sending circuit 104 of the hearing aid system 100 can send audio characteristic control outputs between the first hearing aid 301 and the second hearing aid 302. Also, the audio control sending circuit 104 can connect to a hearing aid network controller 320 (i.e., an external controller, network hub, cloud, etc.). The hearing aid network controller 320 sends signal to other hearing aids in the network 300 such that the first hearing aid 301, upon receipt of the signals from the controller 320, can change an audio characteristic, the wearer of the first hearing aid 301 can leave the room, and the second hearing aid 302 can enter a situation at a later time and automatically have its audio characteristics adjusted according to the changes made by/to the first hearing aid 301.

For example, in a location with a plurality of users having hearing aids (i.e., a nursing home, conference, reunion, etc.), a new user can enter a situation and their hearing aid audio characteristic will be automatically adjusted based on the other hearing aids in the same situation. Thus, if a new user were to enter a room where there was a lot of background noise, their hearing aid would automatically be adjusted by the hearing aid network controller 300 (or a signal from another hearing aid in a one-to-one connection) to cancel the background noise based on the other users hearing aids already cancelling the background noise, or increase the volume.

Further, a picoamp PAN (personal area network) can be used to send hearing aid parameters from one user to another, so that another user may benefit from certain hearing aid settings or a profile related to the voice characteristics of another person. Such a system can be used to convey other information.

In one embodiment, via the PAN, electronic devices on and near the human body can exchange digital information by capacitive coupling picoamp PAN currents through the body, including through a physical handshake of hands between two parties.

The hearing aid system 100 may further include a voice controlling circuit 105 that can force the audio characteristic controller 103 to perform an audio characteristic control based on a voice input of the user. The hearing aid parameters can be controlled by the voice of the user or authorized other party via the voice controlling circuit 105. For example, a code word might be spoken to trigger an authorization needed to change the hearing aid state. Therefore, should the audio characteristic controller 103, for example, perform an incorrect control, the user can override the control using a voice command to provide a different type of control. This attribute could be greatly beneficial, for example, in a hands free environment such as a car.

The hearing aid can further include a sound-receiving microphone from which an incoming signal is supplied to a number of different channels, each channel being allocated to a different frequency range within a total expected range of frequencies for the incoming signal. Each channel includes a circuit for measuring the strength of the signal within the frequency range for that channel and for changing the respective strengths of the signals in the other channels by suppressing weak signal channels in favor of strong signal channels.

It is noted that the hearing aid system 100 need not only apply to the hearing impaired but also can be used in hearing aids to provide a so-called "super-hearing". The hearing aid may automatically learn that a user is in a party situation so as to give hearing aid wearers better speech recognition in cocktail-party situations than people with normal hearing.

The hearing aid system 100 can make use of real time, neuromorphic based Independent Component Analysis (ICA) to aid with blind source separation in the hearing aid. Specifically, given the analysis of cognitive focus of attention, context, engagement with other speakers/listeners, our invention performs an ICA-like analysis of the amplified sound in order to suppress background sources and emphasize the source that is the current focus of attention of the user of the invention.

In the joint assessment by the audio characteristic controller 103, the audio characteristic controller 103 also can weigh the cognitive state and the context of the user. For example, the cognitive state of the user can be 80% of the assessment of which audio characteristic to control versus 20% for the context. Such a weighting may be based on learned preferences of the user.

As discussed previously in the context being used to change the audio characteristics, an identity of the another person prior to the other person speaking can be used to modify the audio characteristics of the hearing aid. For example, if it is determined that the hearing aid wearer is talking to another user (e.g., based on a biometric analysis performed by the hearing aid (e.g. voice recognition) or perhaps even a secondary component such as tiny video camera wireless adjunct), then the hearing aid may increase the volume and change spectral characteristics, because the another user has had a difficult-to-understand or soft voice in the past.

That is, not only can the audio characteristics be modified based on a real-time assessment of another person speaking, the audio characteristics can be modified based on the identify of the person rather than listening to him talking softly now and boosting the volume. Thus, the hearing aid can immediately, prior to the other person speaking, update the audio characteristics. In this way, the approach could also work through the phone. For example, if it can be determined that the identity of the person calling me is the another user, the hearing aid system can be proactive, merely knowing it is the other person, who often speaks fast, slurs his words, etc can pre-emptively change the audio characteristics prior to the another user speaking.

Figure 2:
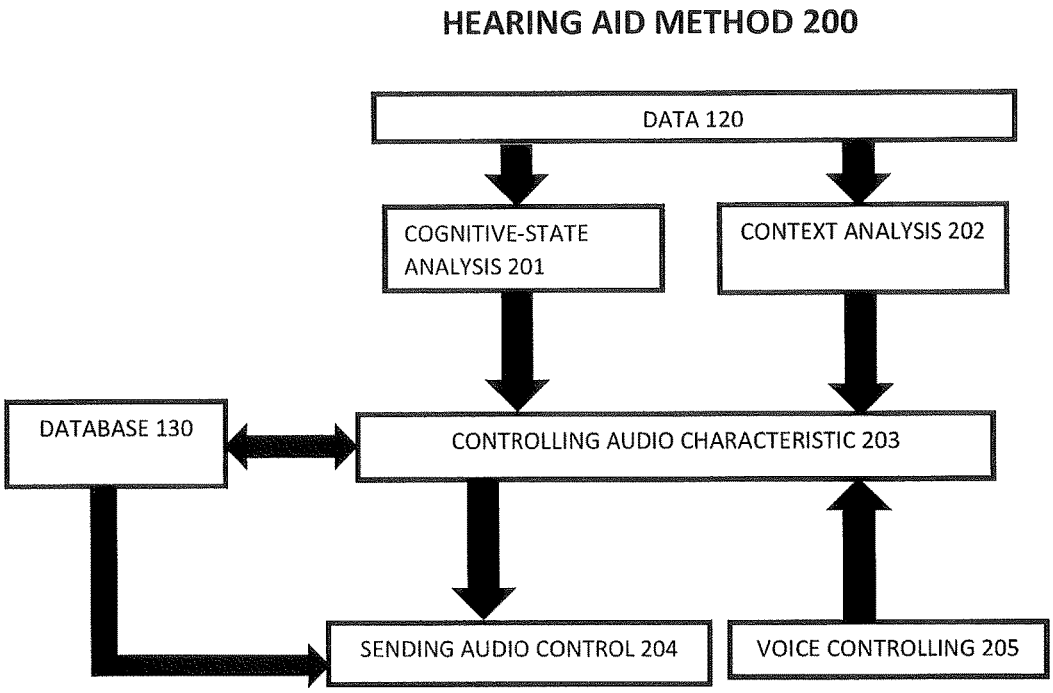
FIG. 2 exemplarily shows a high level flow chart for a hearing aid method 200.

FIG. 2 shows a high level flow chart for a method 200 of hearing aid receiving data 120.

Step 201 receives the data 120 and analyzes a cognitive state of the user based on the data 120.

Step 202 receives the data 120 and analyzes a context of the user based on the data 120.

Step 203 controls audio characteristics by performing a joint assessment of the real-time cognitive state of the user along with an assessment of the real-time context of the user using the analysis of step 201 and step 202. Thus, a joint assessment is performed, Step 203 stores the controls in a database 130.

Step 204 sends audio characteristic control outputs between the first hearing aid 301 and the second hearing aid 302. Also, step 204 can connect to a hearing aid network controller 320 (i.e., an external controller, network hub, cloud, etc.). The hearing aid network controller 320 sends signal to other hearing aids in the network 300 such that the first hearing aid 301 can change an audio characteristic, the wearer of the first hearing aid 301 leaves the room, and the second hearing aid 302 can enter a situation at a later time and automatically have its audio characteristics adjusted according to the changes made by/to the first hearing aid 301.

Step 205 controls step 203 based on voice inputs from a user.

Exemplary Hardware Aspects, Using a Cloud Computing Environment

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client circuits through a thin client interface such as a web browser (e.g., web-based e-mail) The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 4, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10, there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop circuits, multiprocessor systems, microprocessor-based systems, set top boxes, programmable consumer electronics, network PCs, minicomputer systems, mainframe computer systems, and distributed cloud computing environments that include any of the above systems or circuits, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing circuits that are linked through a communications network. In a distributed cloud computing environment, program modules may be located in both local and remote computer system storage media including memory storage circuits.

As shown in FIG. 4, computer system/server 12 in cloud computing node 10 is shown in the form of a general-purpose computing circuit. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external circuits 14 such as a keyboard, a pointing circuit, a display 24, etc.; one or more circuits that enable a user to interact with computer system/server 12; and/or any circuits (e.g., network card, modem, etc.) that enable computer system/server 12 to communicate with one or more other computing circuits. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, circuit drivers, redundant processing units, external disk drive arrays, RAID systems, tape drives, and data archival storage systems, etc.

Referring now to FIG. 5, illustrative cloud computing environment 50 is depicted. As shown, cloud computing environment 50 comprises one or more cloud computing nodes 10 with which local computing circuits used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing circuit. It is understood that the types of computing circuits 54A-N shown in FIG. 6 are intended to be illustrative only and that computing nodes 10 and cloud computing environment 50 can communicate with any type of computerized circuit over any type of network and/or network addressable connection (e.g., using a web browser).

Referring now to FIG. 6, a set of functional abstraction layers provided by cloud computing environment 50 (FIG. 5) is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage circuits 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, more particularly relative to the present invention, the hearing aid system 100 described herein.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A hearing aid system, comprising:

a processor; and a memory, the memory storing instructions to cause the processor to perform:

a cognitive state analysis circuit configured to analyze a cognitive state of a user;

a context analysis circuit configured to analyze a context of the user; and an audio characteristic controller configured to control an audio characteristic of a hearing aid based on a joint assessment of a combined factor calculated by weighing together the cognitive state of the user and the context of the user, wherein the context of the user and the cognitive state of the user are independent of each other, and wherein the cognitive state includes at least one of:

a cohort condition; and a cognitive level.

2. The system of claim 1, wherein the context includes at least one of:

a real-time assessment of another person speaking;

an identity of the another person prior to the another person speaking;

electronic calendar information;

a real-time assessment of eye focus of the user;

interaction between the user and another user of a second hearing aid; and eye focus of the user.

3. The system of claim 1, wherein the audio characteristic includes at least one of:

volume;

frequency shaping;

noise cancellation; and playback.

4. The system of claim 1, wherein the audio characteristic output by the audio characteristic controller is stored in a database, and wherein the audio characteristic controller controls the audio characteristic based on a stored control.

5. The system of claim 1, wherein the cognitive state is determined based on at least partially an accelerometer and a Global Positioning System (GPS) in the hearing aid.

6. The system of claim 1, further comprising a voice controlling circuit configured to control the audio characteristic controller to perform a particular audio characteristic control based on an input voice command from the user.

7. The system of claim 1, further comprising an audio control sending circuit configured to send the controlled audio characteristic to an audio characteristic controller of a second hearing aid.

8. The system of claim 7, wherein the audio control sending circuit sends the controlled audio characteristic to a hearing aid network controller configured to send the controlled audio characteristic to the second hearing aid.

9. The system of claim 1, wherein the audio characteristic controller learns to control the audio characteristic based on a stored control in a database.

10. The system of claim 1, wherein the cognitive state comprises functions of measures of the user's total behavior collected over a period of time from information of the user within a lower dimensional feature space.

11. The system of claim 10, wherein a reduction of a set of behavioral measures over the period of time to a set of feature nodes and vectors, corresponding to the behavioral measures' representations in the lower dimensional feature space, is used to identify an emergence of the cognitive state over the period of time.

12. A hearing aid method, comprising:

analyzing a cognitive state of a user;

analyzing a context of the user; and controlling an audio characteristic of a hearing aid based on a joint assessment of a combined factor calculated by weighing together the cognitive state of the user and the context of the user, wherein the context of the user and the cognitive state of the user are independent of each other, and wherein the cognitive state includes at least one of:

a cohort condition; and a cognitive level.

13. The method of claim 12, wherein the context includes at least one of:

a real-time assessment of another person speaking;

an identity of the another person prior to the another person speaking;

electronic calendar information;

a real-time assessment of eye focus of the user;

interaction between the user and another user of a second hearing aid; and eye focus of the user.

14. The method of claim 12, wherein the audio characteristic includes at least one of:

volume;

frequency shaping;

noise cancellation; and playback.

15. The method of claim 12, wherein the audio characteristic is output by the controlling and is stored in a database, and wherein the controlling controls the audio characteristic based on a stored control.

16. A non-transitory computer-readable recording medium recording a hearing aid program, the program causing a computer to perform:

analyzing a cognitive state of a user;

analyzing a context of the user; and controlling an audio characteristic of a hearing aid based on a joint assessment of a combined factor calculated by weighing together the cognitive state of the user and the context of the user, wherein the context of the user and the cognitive state of the user are independent of each other, and wherein the cognitive state includes at least one of:

a cohort condition; and a cognitive level.

17. The non-transitory computer-readable recording medium of claim 16, wherein the context includes at least one of:

a real-time assessment of another person speaking;

an identity of the another person prior to the another person speaking;

electronic calendar information;

a real-time assessment of eye focus of the user;

interaction between the user and another user of a second hearing aid; and eye focus of the user.

18. The non-transitory computer-readable recording medium of claim 16, wherein the audio characteristic includes at least one of:

volume;

frequency shaping;

noise cancellation; and playback.

19. The non-transitory computer-readable recording medium of claim 16, wherein the audio characteristic is output by the controlling and is stored in a database, and wherein the controlling controls the audio characteristic based on a stored control.

* * * * *